US006034609A

United States Patent [19]

Comiskey, Jr.

[11] Patent Number: 6,034,609

[45] Date of Patent: Mar. 7, 2000

[54] MOTORLESS TRAFFIC-CONTROL SIGN AUTOMATICALLY RESPONSIVE TO STATE OF ELECTRICAL POWER

[76] Inventor: Donald V. Comiskey, Jr., 4N224 Wiant Rd., West Chicago, Ill. 60185

[21] Appl. No.: 09/234,346

[22] Filed: Jan. 20, 1999

[51] Int. Cl.[7] ..... G08G 1/097

[52] U.S. Cl. ..... 340/631; 340/632.1; 340/815.86; 40/503; 40/505

[58] Field of Search ..... 340/907, 908, 340/927, 930, 931, 932.1, 815.86; 116/63 P, 63 R; 40/502, 503, 504, 505

[56] References Cited

U.S. PATENT DOCUMENTS

| | | | |
|---|---|---|---|
| 3,863,214 | 1/1975 | Kerr, Jr. | 340/932.1 |
| 4,015,255 | 3/1977 | Wood | 340/373 |
| 4,295,127 | 10/1981 | Sautter et al. | 340/373 |
| 4,642,605 | 2/1987 | Karp | 340/931 |
| 5,003,716 | 4/1991 | Dyar | 40/503 |
| 5,504,481 | 4/1996 | Wys | 340/931 |
| 5,572,816 | 11/1996 | Anderson, Jr. et al. | 40/505 |

OTHER PUBLICATIONS

Attached drawing of a folded mechanical stop sign commonly used (seen) in the field to supplement traffic signals.

*Primary Examiner*—Jeffery A. Hofsass
*Assistant Examiner*—Van T. Trieu

[57] ABSTRACT

A traffic-control sign that automatically displays a primary message, such as "STOP", when electrical power is absent, and an optional secondary message, such as "We Arrest Drunk Drivers", when electrical power is present. The motorless sign is continually encompassed by an enclosure having a transparent facade. A plurality of pivotally-mounted louver panels arranged in a louvered fashion are viewable through the transparent facade. A linkage rod interconnecting the panels provides for unison rotation of the panels. The linkage rod communicates with a solenoid so that the panels assume two distinct positions dependent on the state of the solenoid. These distinct positions reveal primary and secondary viewing surfaces to which the respective messages are affixed. Panel travel approximating 180 degrees allows the messages to be displayed on the overall viewing surfaces formed by the combined individual panel surfaces. Panel travel approximating 90 degrees allows one message to be displayed on the panels and the other message to be displayed on a separate viewing surface located behind the panels. Thus, the solenoid being energized by an electrical power source causes the panel orientation to reveal the optional secondary message and conceal the primary message. Upon removal or loss of electrical power, such as during a power outage, the solenoid de-energizes and causes the panel orientation to reveal the primary message ("STOP") and conceal the secondary message. The sign is ideally suited to supplement a traffic signal and is mountable to a support pole thereof.

6 Claims, 4 Drawing Sheets

Prior Art Reference

MOTORLESS TRAFFIC-CONTROL SIGN AUTOMATICALLY RESPONSIVE TO STATE OF ELECTRICAL POWER

BACKGROUND OF INVENTION

1. Field of Invention

This invention relates to traffic-control signs, specifically supplemental warning signs, usually bearing the message "STOP", that are used to back-up traffic signals that have been disabled by a power failure.

2. Description of Prior Art

A number of devices intended to supplement a disabled traffic signal in the event of a power failure are known in the related art:

In U.S. Pat. No. 3,863,214, Kerr, Jr. describes a supplemental visual display that cooperates with the operational mode of a traffic signal. The device is mounted to the back-side of a traffic signal housing and includes an arm that supports a visual display at one end and is rotatably secured to the shaft of an electric motor at its other end. An electromagnet is used to retain the arm in a normally upward position so that the visual display is hid behind the traffic signal housing. During a power failure, the electromagnet is released and a spring plunger assists the downward free fall of the arm so that the display is shown along the side of the traffic signal. Restoration of power causes the motor to raise the arm back to its original position where the arm contacts a normally closed switch that disconnects power to the motor.

In U.S. Pat. No. 4,642,605, Karp describes a power failure responsive warning device mountable to the side of a traffic signal housing. The device includes an arm pivotally mounted to a frame member and normally retained in an upright non-warning mode position by an electromagnet, such that the arm and frame member enclose a collapsible warning sign. Power interruption causes the electromagnet to release the arm so that the arm downwardly pivots away from the frame so as to unfold the collapsible sign. The device provides no mechanism for automatically returning the sign to the original non-warning position. Instead, the free end of the arm includes a reset plate that accepts the end of a hand-held pole in order to manually return the sign to its original position. To prevent unlatching of the arm during a momentary power glitch, the device includes a time delay circuit connected to the electromagnet.

In U.S. Pat. No. 5,504,481, Wys describes a fail-safe stop light apparatus that covers the face of a traffic signal with a warning sign as a result of a power failure. The device includes two members, each rotatably mounted to opposites sides of the traffic signal. Two electromagnets are used to retain each member in a first position away from the face of the traffic light. The electromagnets release the members during a power failure and two coil springs cause the members to rotate to a second position covering the face of the traffic light. An electric motor communicates with two linkage mechanisms to rewind the members to the original first position upon resumption of electrical power. A shut-off means, such as a switch or timer, is used to stop the motor once the members have been sufficiently rotated.

Actual field usage of the above-mentioned devices has not been obvious. Instead, the device most commonly used in the field to supplement a disabled traffic signal is the folded mechanical device shown for reference purposes in FIGS. 1A and 1B of the attached drawings. The device is usually mounted to the same pole used by the traffic signal and located below the traffic signal, so as to be accessible to a standing person. In some cases, the device may be mounted to a nearby support structure, such as a street light pole, which is in close proximity to the traffic signal. The device usually consist of two symmetrical halves of a typical stop sign that are connected together by a hinge mechanism. One sign half is usually fixed (mounted) to the traffic signal support pole and the other half is movable. Under normal conditions, the movable half of the sign is folded over the fixed half of the sign so as to not display the "STOP" message. Usually, there are matching holes or slots in the two sign halves to accept a padlock, or a hasp-type component which then accepts a padlock, in order to prevent tampering and limit access to the proper authorities, such as police or government officials. In order to display the "STOP" message using this device, an authorized individual manually unlocks the padlock, unfolds the two sign halves, and secures the sign in the open position (usually with a hasp-type component and padlock). This process is reversed in order to return the device to the normal folded position. An optional smaller message is sometimes affixed to the back of the movable half of the sign and is displayed when the sign is in the folded position.

Numerous disadvantages become apparent in the above detailed descriptions of the related art. The folded mechanical device, presumably popular because of its simplicity and ease of installation, has the major disadvantage of being manually activated. This manual activation can result in significant delays before the warning message is deployed and/or retracted, creating dangerous situations at traffic intersections. Although Kerr, Jr. and Wys present devices which activate automatically, the deployment methods are somewhat cumbersome, each device requires more than one electromechanical/magnetic component, including an electric motor with switch means to retract the warning message, and installation of the device requires modification to the traffic signal housing. Although Karp presents a device that does not use a motor or switch means, the resultant device is only semi-automatic, requiring the warning message to be manually retracted as in the case of the folded mechanical device. Karp's device also requires the added delay circuit to prevent nuisance deployment of the warning message, and installation requires modification to the traffic signal housing. All of the above-mentioned devices have working components that are exposed to the outside weather elements such as wind, rain, snow, ice, and corrosive elements like road salt, possibly causing damage to the device and/or hindering its movement. Karp acknowledges that modifications may need to be made to the collapsible sign to minimize the possibility of damage due to wind gusts. The hinge component and padlock used on the folding mechanical device are often seen to be rusted. The devices having exposed components are also subject to possible tampering, as is evident by the need for the padlock on the folding mechanical device.

BRIEF SUMMARY OF THE INVENTION

Throughout the specification of the present invention, the terms "primary" and "secondary" are used to describe certain components of the invention. The term "primary" is meant to be associated with the critical function of the invention, which is to display a warning message in emergency situations. The term "secondary" is meant to be associated with an additional function of the invention, which is to display an optional message in non-emergency situations.

The present invention is a traffic-control sign that automatically displays a primary warning message, such as "STOP", when electrical power is absent, and an optional secondary message, such as "We Arrest Drunk Drivers", when electrical power is present. An encompassing enclosure with a transparent facade continually houses the sign components. Pivotably-mounted louver panels arranged in a louvered fashion are viewable through the transparent facade. The panels are controllably oriented using an interconnecting linkage rod communicating with a solenoid, so that the panels assume two distinct positions depending on the state of the solenoid. The distinct panel positions reveal primary and secondary viewing surfaces to which the respective messages are affixed. A viewing surface may be comprised of the combined individual panel surfaces and/or a separate surface located behind the panels. Thus, the solenoid being energized by an electrical power source causes the panel orientation to display the optional secondary message and conceal the primary "STOP" message. Contrarily, the solenoid being de-energized by the loss of electrical power causes the primary "STOP" message to be displayed and the optional secondary message to be concealed. The present invention is ideally suited to supplement a traffic signal and is mountable to a support pole thereof using piping components commonly used to install related traffic fixtures.

OBJECTS AND ADVANTAGES

Safety is the prime importance of the present invention. Use of the present invention can help to prevent traffic accidents and reduce the risk of death or injury to human beings.

Accordingly, several objects and advantages of the present invention are:

(a) to provide a new and improved traffic-control sign that is used to provide supplemental traffic control in cases where the normal method of control, usually being a traffic signal, becomes disabled by the interruption of electrical power;

(b) to provide a supplemental traffic-control sign that is fully-automatic so as to provide quick response to emergency situations, in particular, to provide quick deployment and retraction of a warning message, such as "STOP", in accordance with the operational state of a traffic signal;

(c) to provide a supplemental, fully-automatic traffic-control sign that accomplishes both the automatic deployment and retraction of a warning message through the use of a single electromechanical device, such as a solenoid, and in particular, a sign that does not require an electric motor, switch means, and/or delay circuitry;

(d) to provide a supplemental, fully-automatic traffic-control sign that is continually encompassed by its own enclosure so as to make it inherently weather-resistant and tamper-proof;

(e) to provide a supplemental, fully-automatic traffic-control sign that is non-cumbersome and easily mounted to a support pole, such as a traffic light pole, with attachment components that are commonly used to install related traffic fixtures, and in particular, a sign that is installed without modification to the traffic signal housing; and (f) to provide a supplemental, fully-automatic traffic-control sign that can optionally display an adequately sized secondary message, such as "No Turn on Red", during the time when electrical power is present and the primary message ("STOP") is not displayed, making for efficient use of signage.

Further objects and advantages of the present invention will become apparent from the ensuing description and drawings.

BRIEF DESCRIPTION OF DRAWING FIGURES

FIG. 1A shows the closed position of the sign, and FIG. 1B shows the open position of the sign;

FIG. 2A shows the front view of the invention, and FIG. 2B shows the side view of the invention;

FIG. 3A represents the back side of the louver panels used by the invention, and FIG. 3B represents the front side of the louver panels and the resulting message viewed by a motorist;

FIG. 4A represents the back side of the louver panels used by the invention, and FIG. 4B represents the front side of the louver panels and the resulting message viewed by a motorist.

REFERENCE NUMERALS IN DRAWINGS

| | | | |
|---|---|---|---|
| 11 | louver panels | 16 | interconnecting linkage rod |
| 12 | pivot frame | 17 | spring-loaded solenoid |
| 13 | enclosure | 17a | integral spring of solenoid |
| 13a | transparent facade of enclosure | 18 | primary viewing surface |
| 14 | piping components | 19 | primary message |
| 14a | contoured mounting plate of piping components | 20 | secondary viewing surface |
| 15 | pivot members | 21 | secondary message |

DESCRIPTION OF THE PREFERRED EMBODIMENT

Figure 1A:
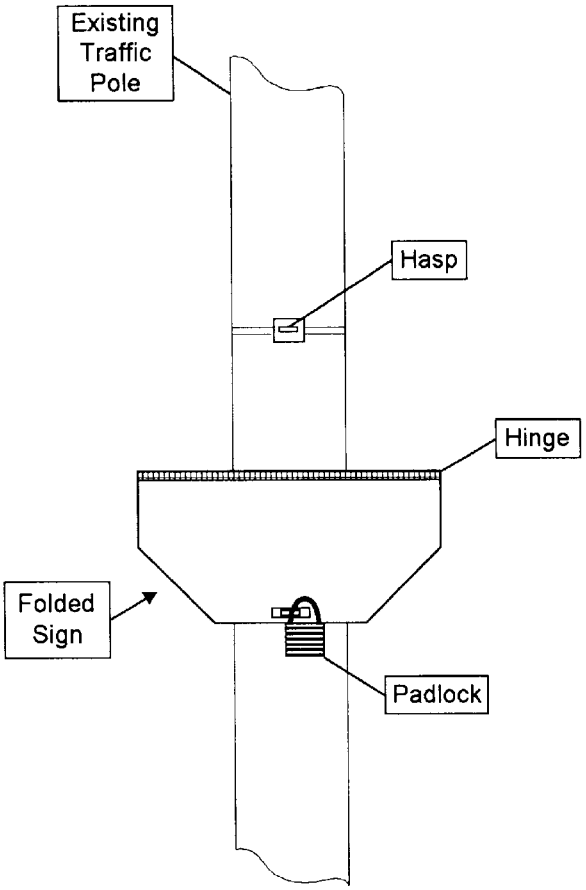
FIGS. 1A and 1B show a commonly used Prior Art sign (referred to in Description of Prior Art) mounted to an existing traffic signal support pole, where
Figure 1B:
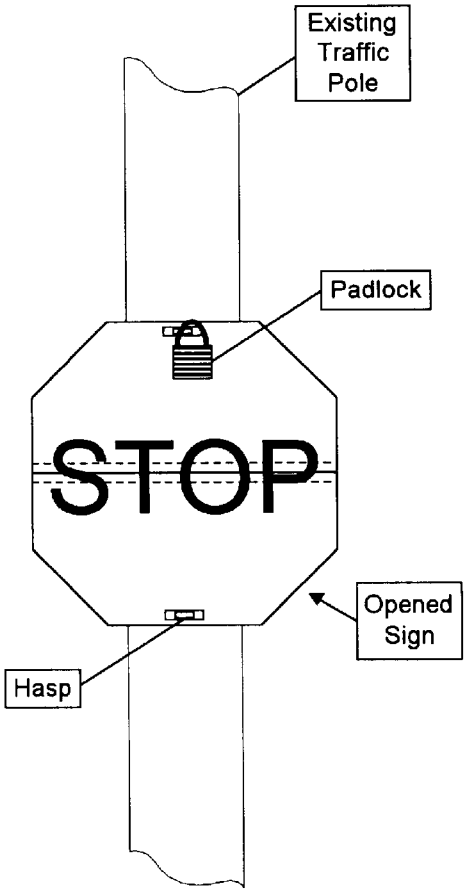
Figure 2A:
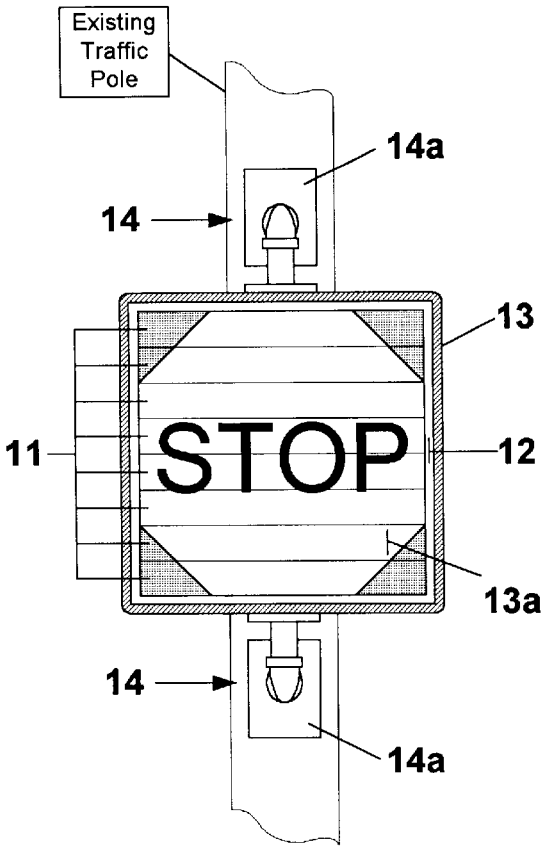
FIGS. 2A and 2B show the present invention mounted to an existing traffic signal support pole, where
Figure 2B:
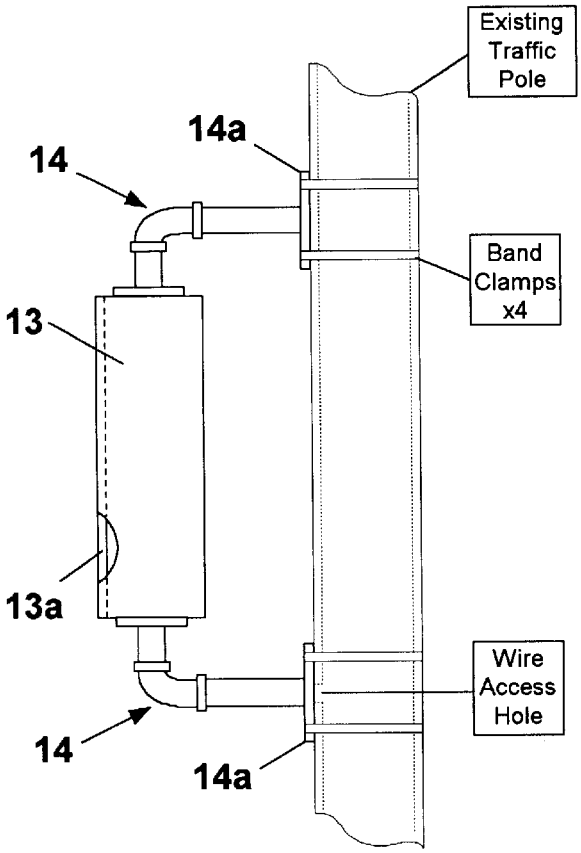

Referring to FIGS. 2A and 2B, the present invention is comprised of a plurality of louver panels 11, arranged in a louvered fashion, that are pivotably-mounted to a pivot frame 12 and continually encompassed by an enclosure 13. The pivot frame 12 could actually be an integral part of the enclosure 13. The enclosure 13 is comprised of materials suitable for outdoor environments, with its facade (frontal surface) 13*a* being a transparent material through which the louver panels 11 can be viewed. Piping components 14, like that used for related traffic signal fixtures, are attached to the outside of the enclosure 13. The piping components 14 usually include a contoured mounting plate 14*a* which allows for mounting to a circular pole. FIG. 2B shows how the contoured mounting plate 14*a* can be attached to an existing traffic signal pole using typical band-clamps, which is a common method used to mount related traffic signal fixtures. FIG. 2B also depicts an access hole that would be placed in the existing traffic signal pole in order to run electrical wires between the inside of the enclosure 13 and the inside of the pole through the piping components 14.

Referring to FIGS. 3A, 3B, 4A, and 4B, the louver panels 11, which would ideally be comprised of a lightweight material, are arranged in a louvered fashion and utilize pivot members 15 to mate with openings or recesses in the pivot frame 12 (FIG. 2A). The pivot members 15, which could actually be extensions of the panels 11 themselves, allow rotation of the panels 11. An interconnecting linkage rod 16 is used to interconnect the panels 11 in such a manner so as to rotate the panels 11 in unison around the pivot points established by the pivot members 15. The interconnecting linkage rod 16 is acted upon by a spring-loaded solenoid 17, or similar electromechanical device, which would normally be mounted to the pivot frame 12 or enclosure 13 (FIG. 2A).

Furthermore, the combined actions provided by the interconnecting linkage rod 16 and the solenoid 17 limit the rotation of the panels 11 to approximately 180 degrees, and cause the positioning of the panels 11 to be bistable, so as to assume positions approximating either 0 degrees or 180 degrees. In these two distinct positions, the louver panels 11 will be aligned nearly within the same relative plane, so as to appear, from a distance, as a continuous single panel with a surface area approximately equal to that of an individual panel multiplied by the number of panels 11, providing an overall viewing surface 18 or 20. The viewing surface 18 or 20 created by the panels 11 will be in parallel or nearly in parallel with that of the transparent facade 13*a* of the enclosure 13 (FIGS. 2A and 2B), allowing a message 19 or 21 affixed to the viewing surface 18 or 20 created by the panels 11 to be observed through the transparent facade 13*a* (FIGS. 2A and 2B). Since the panels 11 can be oriented in two distinct positions, two separate viewing surfaces 18 and 20 are available to respectively affix two distinct messages 19 and 21. The means for affixing the message 19 or 21 is dependent on the material used for the panels 11 and can include etching, screening, embossing, painting, pressure-sensitive application, and/or other such means. Ideally, the message 19 or 21 will have the same luminous (reflective) qualities common with related traffic signs. The "STOP" message 19 should be affixed in such a way so as to resemble a typical stop sign.

OPERATION OF PREFERRED EMBODIMENT

Figures 3A, 3B:
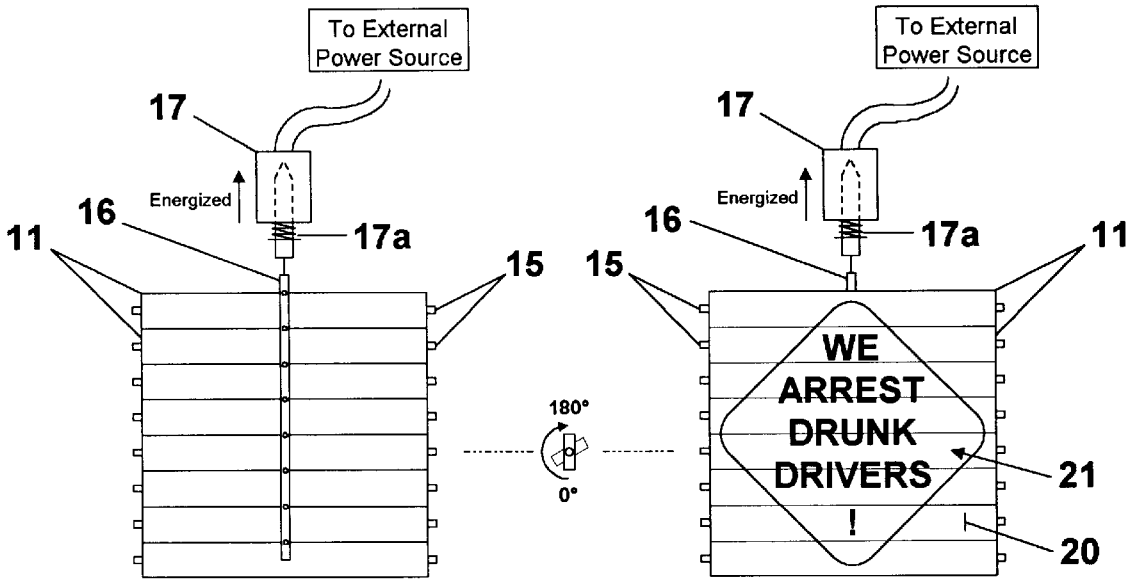
FIGS. 3A and 3B depict the internal working components and the energized state (power applied) of the present invention, where

Referring to FIGS. 3A and 3B, the wires of the solenoid 17 would connect to the same electrical power source, or a derivation thereof, used to power the traffic signal being supplemented by the present invention. Upon application of electrical power, at which time the traffic signal becomes functional, the solenoid 17 becomes energized. In transitioning to the energized state, the solenoid 17 overcomes the action presented by its integral spring 17*a* and acts upon the interconnecting linkage rod 16 to cause the panels 11 to rotate in unison around the pivot points established by the pivot members 15. The panels 11 rotate to a position approximately 180 degrees from that of the de-energized state of the solenoid 17, revealing an overall secondary viewing surface 20 from which a (optional) secondary message 21, such as "We Arrest Drunk Drivers", is viewed through the transparent facade 13*a* of the enclosure 13 (FIGS. 2A and 2B). The secondary message 21, as shown in FIG. 3B, will be continually displayed to a motorist while the solenoid 17 is energized by the presence of electrical power.

Figures 4A, 4B:
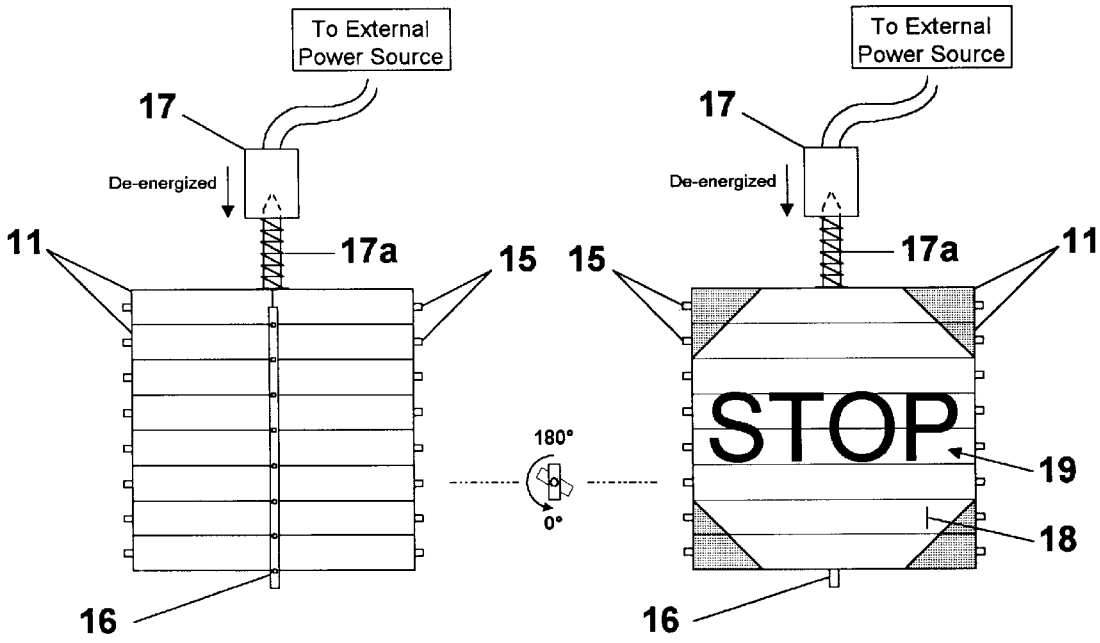
FIGS. 4A and 4B depict the internal working components and the de-energized state (power removed) of the present invention, where

Referring to FIGS. 4A and 4B, upon removal or loss of electrical power, at which time the traffic signal becomes disabled, the solenoid 17 becomes de-energized. In transitioning to the de-energized state, the solenoid 17 no longer acts upon the interconnecting linkage rod 16 and does not overcome the action presented by its integral spring 17*a*. Instead, the integral spring 17*a* of the solenoid 17 acts upon the interconnecting linkage 16 rod to cause the panels 11 to rotate in unison around the pivot points established by the pivot members 15. The panels 11 rotate to a position approximately 180 degrees from that of the energized state of the solenoid 17, revealing an overall primary viewing surface 18 from which a primary message 19, such as "STOP", is viewed through the transparent facade 13*a* of the enclosure 13 (FIGS. 2A and 2B). The primary message 19, as shown in FIG. 4B, will be continually displayed to a motorist while the solenoid 17 is de-energized by the absence of electrical power.

SUMMARY, RAMIFICATIONS, AND SCOPE

Accordingly, the reader will see that the present invention is a new and improved traffic-control sign that is ideally suited to supplement a traffic signal and is mountable to a support pole thereof. The supplemental sign cooperates with the operational state of the traffic signal by automatically displaying a warning message, such as "STOP", when electrical power is interrupted, and an optional message, such as "No Turn on Red", when electrical power is present. The sign is motorless and accomplishes both the automatic deployment and retraction of the warning message through the use of a single solenoid. Furthermore, the sign is all-comprised in a tamper-proof/weather-resistant enclosure, and is easily mounted to a traffic signal pole using components commonly used to install related traffic fixtures (installation requiring no modification to the traffic signal housing). Use of the present invention can help to prevent traffic accidents and reduce the risk of death or injury to human beings.

Although the description of the present invention contains many specificities, these should only be construed as an illustration of the presently preferred embodiment of the invention, and not a limitation of the spirit and scope of the invention. Accordingly, many other variations may become apparent to one skilled in the art. For example:

(a) the solenoid does not have to be spring-loaded if movement to the de-energized positioned can be assisted through the use of offset pivot points, a counterweight, a separate spring, gravitational effects associated with the physical attributes of the panels, and/or other such means;

(b) the solenoid does not have to be connected directly to the interconnecting linkage rod and may, for example, be connected to an individual panel or a pivot member associated with an individual panel, since movement of an individual panel causes movement of the remaining panels because of the interconnecting linkage rod;

(c) positioning of the interconnecting linkage rod is not limited to the center of the panels and may be located at other positions along the panels or possibly connected to the pivot members;

(d) the electrical power source for the solenoid is not limited to a direct connection to the power source used for the traffic signal and may, for example, be connected to a transformed and/or rectified derivation of that power source, or connected to the electrical output of a logical function which monitors the status of the traffic signal;

(e) other embodiments, where an optional message is not needed or if the panels are used to obstruct and reveal a message that is affixed to a surface located behind the panels, may limit the panel travel to approximately 90 degrees instead of 180 degrees;

(f) the panels may be arranged in a sliding louvered fashion rather than a pivoting louvered fashion, where the solenoid and the interconnecting linkage control the position of the sliding panels to display the appropriate message;

(g) a switch, such as a key switch, may be mounted to the enclosure and connected in series with the solenoid in order to manually interrupt the power to the solenoid and activate the "STOP" message;

(h) lighting means may be included within the enclosure, possibly employing a photo-sensitive device responsive to outdoor light;

(i) a battery-operated (flashing) light, which can be mounted to the enclosure, may be used in conjunction with the "STOP" message. An electrical device can be used to disable the light during conditions when electrical power is present and the traffic signal is functional, and enable the light upon removal of electrical power and display of the "STOP" message. During the conditions when electrical power is present, a modification of the electrical power can be used to charge the battery used to operate the light;

(j) the support structure to which the invention is mounted should not be limited to the traffic signal pole and may, for example, be mounted to a street light pole or similar structure in close proximity to the traffic signal;

(k) the enclosure may have opposing transparent facades and may be mounted in such a manner so as to allow the panels to be viewable from opposite sides of the enclosure; and (l) the present invention has the potential to be used for other traffic related applications, such as an emergency back-up sign for disabled railroad crossing signals.

Thus the scope of the present invention should be determined by the attached claims and their legal equivalents, rather than be limited to the specific examples given.

I claim:

1. A motorless traffic-control sign for automatic display of an inherent primary stop message when external electrical power is absent and an inherent optional secondary message when said electrical power is present, comprising:

(a) a protective enclosure at all times surrounding all working components of said sign and having at least one transparent facade, (b) a plurality of movably-mounted louver panels arranged in a louvered fashion and viewable through said facade, (c) an interconnecting linkage rod freely communicating with said panels so as to provide unison positioning of said panels, (d) a solenoid communicating with said linkage rod so as to orient said panels in two distinct positions according to the state of said solenoid, (e) inherent primary and secondary viewing surfaces bearing respective said messages and made selectively viewable through said facade according to the distinct positioning and travel of said panels, and (f) piping components, of the type used to mount related traffic-control fixtures, attached to said enclosure so as to enable mounting of said enclosure to an external traffic pole, whereby said sign, ideally suited to supplement and operationally cooperate with an external traffic signal, automatically displays and retracts said inherent primary and secondary messages solely according to the state of said solenoid connected to said electrical power.

2. The sign of claim 1 wherein said inherent primary and secondary viewing surfaces are formed by the combined individual surfaces of said panels.

3. The sign of claim 1 wherein one of said inherent primary and secondary viewing surfaces is formed by the combined individual surfaces of said panels, and the other of said primary and secondary viewing surfaces is located behind said panels.

4. The sign of claim 1 wherein said panels arranged in a louvered fashion are pivotably-mounted such that said inherent primary and secondary viewing surfaces are made selectively viewable through said facade as a result of said panels being operatively pivoted in two distinct positions by the action of said solenoid communicating with said linkage rod.

5. The sign of claim 1 wherein said panels arranged in a louvered fashion are slidably-mounted such that said inherent primary and secondary viewing surfaces are made selectively viewable through said facade as a result of said panels being operatively slid in two distinct positions by the action of said solenoid communicating with said linkage rod.

6. The sign of claim 1 wherein said enclosure has opposing transparent facades so that said panels are viewable from opposite sides of said enclosure.

* * * * *